US005131335A

United States Patent [19]

Spliethoff et al.

[11] Patent Number: 5,131,335

[45] Date of Patent: Jul. 21, 1992

[54] PROCESS FOR REDUCING NITRIC OXIDE EMISSION DURING THE COMBUSTION OF SOLID FUELS

[75] Inventors: Heinz Spliethoff, Friedrichsthal; Hartmut Spliethoff, Stuttgart, both of Fed. Rep. of Germany

[73] Assignee: Saarbergwerke Aktiengesellschaft, Saarbrücken, Fed. Rep. of Germany

[21] Appl. No.: 752,464

[22] PCT Filed: Dec. 21, 1990

[86] PCT No.: PCT/DE90/00985

§ 371 Date: Aug. 26, 1991

§ 102(e) Date: Aug. 26, 1991

[87] PCT Pub. No.: WO91/10097

PCT Pub. Date: Jul. 11, 1991

[30] Foreign Application Priority Data

Dec. 27, 1989 [DE] Fed. Rep. of Germany ..... 3943084

[51] Int. Cl.[5] ..... F23J 11/00; F23J 15/00

[52] U.S. Cl. ..... 110/345; 110/212; 110/214; 422/182; 422/183; 431/5

[58] Field of Search ..... 110/212, 345, 213, 214, 110/342, 344; 422/182, 183; 431/5

[56] References Cited

U.S. PATENT DOCUMENTS 4,779,545 10/1988 Breen et al. ..... 110/212
5,078,064 1/1992 Breen et al. ..... 110/212

FOREIGN PATENT DOCUMENTS 0159492 10/1985 European Pat. Off. .
58-120004 7/1983 Japan .
58-156104 9/1983 Japan .
58-190605 11/1983 Japan .
8700186 4/1987 PCT Int'l Appl. .

*Primary Examiner*—Edward G. Favors
*Attorney, Agent, or Firm*—James Creighton Wray

[57] ABSTRACT

In a process for reducing the nitric oxide emission during the combustion of solid fuels, the flue gases leaving from a main combustion zone (2) consecutively flow through two reduction zones (6,9). The first reduction zone (6) is operated hypostoichiometrically at temperatures above 1,000° C. and while adding a reducing fuel, while the second reduction zone (9) is operated hyperstoichiometrically at temperatures from 950° C. to 1,000° C. and in the presence of nitric oxide-reducing substances.

5 Claims, 1 Drawing Sheet

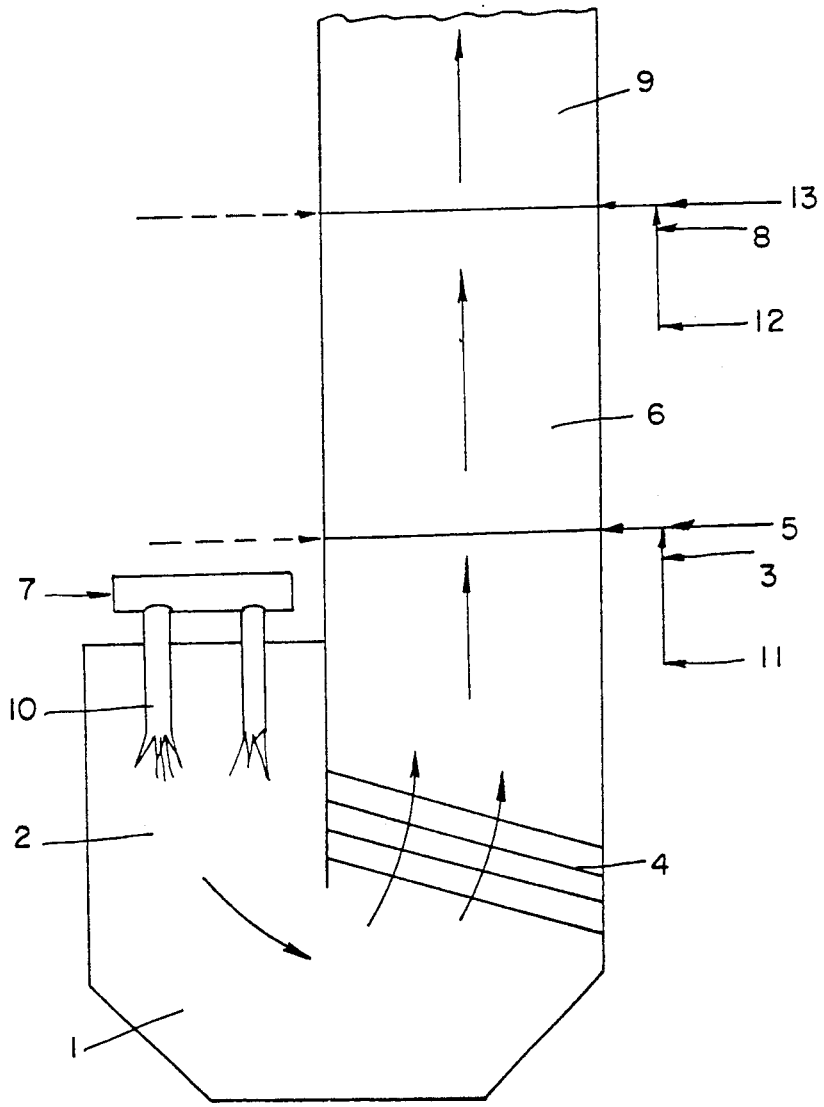
9
13
8
12
6
5
3
11
7
10
2
4
1

PROCESS FOR REDUCING NITRIC OXIDE EMISSION DURING THE COMBUSTION OF SOLID FUELS

BACKGROUND OF THE INVENTION

The invention relates to a process for reducing the nitric oxide emission during the combustion of solid fuels, particularly of hard coals, whereby reducing fuel is added to flue gases leaving a main combustion zone and is burned.

Nitric oxide emission of combustion plants operated with solid fuels may be influenced both by suitable control of the combustion process, so-called primary measures, and by the treatment of the flue gases leaving the combustor, so-called secondary measures.

While the primary measures are intended to reduce the generation of nitric oxides in the combustor, the secondary measures have the goal of removing the generated nitric oxides from the flue gases leaving the combustor.

Known secondary measures are e.g. the catalytic processes for the selective separation of nitric oxides. But these processes are complex and expensive. The disposal of the used or loaded catalysts also causes problems.

Another, comparatively simple, possibility for reducing nitric oxide emission consists of mixing an additional reducing fuel to the flue gases leaving the main combustion zone of a combustor and to burn it in a so-called reduction zone. But this measure by itself is often not sufficient for keeping within the limits of legally prescribed emission limits for nitric oxides so that secondary measures such as e.g. catalytic denitrogenation as a rule cannot be foregone.

SUMMARY OF THE INVENTION

It is therefore the task of this invention to improve this process of the initially described type in such a way that high denitrogenation degrees may be realized in a simple and economical manner.

According to the invention this task is solved in that the flue gases pass consecutively through two reaction zones; that the first reaction zone is operated hypostoichiometrically at temperatures above 1,000° C., and while adding a reducing fuel; and that the second reduction zone is operated hyperstoichiometrically in the presence of nitric oxide-reducing substances at temperatures from 950° C. to 1,000° C. The used nitric oxide-reducing substances are primarily ammonia, ammonia water, carbamide solutions, etc.

The overall denitrogenation degree is improved perceptively by the invented combination of nitric oxide reduction by means of a reducing fuel in a hypostoichiometric reduction zone and nitric oxide-reducing substances in a hyperstoichiometric reduction zone.

The nitric oxide-reducing substances preferably are added, at least in part, together with the reduction fuel to the first reduction zone. This already further increases the nitrix oxide reduction in the first reduction zone, since in the hypostoichiometric atmosphere present there the nitric oxide-reducing substances have an additional reducing effect even at the high temperatures above 1,000° C. The remaining time of the fuel gases in this first reduction zone should preferably be at least 0.1 s.

The additional nitric oxide reduction then takes place in the second reduction zone through the nitric oxide-reducing substances, whereby the hyperstoichiometric parameters however require a temperature range from 950° C. to 1,000° C. The adjustment of the hyperstoichiometric conditions in the second reduction zone is preferably accomplished through addition of an excess volume of combustion air above the requirement necessary for the complete combustion of the reduction volume.

According to another characteristic of the invention, the narrow temperature range which must be maintained for hyperstoichiometric conditions may be kept simply and accurately by controlling the volume and temperature of added combustion air. Since the nitric oxide-reducing substances are already added in the first reduction zone, it is ensured that they pass evenly distributed in the flue gas through the temperature range which must be maintained for nitric oxide reduction.

The invented process is further described using a melting chamber combustor shown as an example in the drawing.

BRIEF DESCRIPTION OF THE DRAWING

The drawing is a schematic representation of the process for reducing nitric oxide emission.

DETAILED DESCRIPTION OF THE DRAWING

A combustor 1 has a main combustion zone 2 with burners 10 and a fuel input 7. The flue gases of the main combustion zone 2 are in the shown example of a melting chamber combustor deflected by 180° and passed through a collecting grid 4. The deflected flue gas stream then consecutively streams through reduction zones 6 and 9. Into the first reduction zone 6 which has hypostoichiometric conditions and a temperature above 1,000° C., via duct 5 a reducing fuel and via duct 3 nitric oxide-reducing substances measured to the former are introduced into the flue gas stream and are mixed with it. The introduction may also take place, as indicated in the drawing, at several introduction points which are distributed over the circumference of the reduction zone 6. Additional flue gas may be recirculated via duct 11 in order to support the mixing by increasing the flowing pulse.

The streaming length of the first reduction zone 6 is sufficiently large to ensure a remaining time of the flue gases of at least 0.1 s in this reduction zone 6. A sufficiently large volume of combustion air is mixed into the flue gas via duct 13 at the end of the first reduction zone and ensures that hyperstoichiometric conditions are present in reduction zone 9, whereby the temperature range from 950° C. to 1,000° C. which is necessary for nitric oxide reduction in hyperstoichiometric atmosphere is also adjusted by way of the volume and temperature of the added combustion air. Additional nitric oxide-reducing substances may be added via duct 8, for better mixing, preferably together with the combustion air, and optionally here also with flue gas recirculated via duct 12, whereby the ratio of recirculated flue gas to fresh air is limited by the requirements for a hyperstoichiometric atmosphere. The introduction may also take place at several introduction points which are distributed over the circumference of the second reduction zone 9.

We claim:

1. Process for the reduction of nitric oxide emission during the combustion of solid fuels, particularly hard coals, whereby a reducing fuel is added to the flue gases leaving a main combustion zone and is burned, characterized in that the flue gases pass consecutively through two reaction zones; that the first reaction zone is operated hypostoichiometrically at temperatures above 1,000° C. and while adding a reducing fuel; and that the second reduction zone is operated hyperstoichiometrically in the presence of nitric oxide-reducing substances at temperatures from 950° C. to 1,000° C.

2. Process according to claim 1, characterized in that the nitric oxide-reducing substances are added at least partially together with the reducing fuel into the first reduction zone.

3. Process according to claim 1, characterized in that the remaining time of the flue gases in the first reduction zone is at least 0.1 s.

4. Process according to claim 1, characterized in that the hyperstoichiometric conditions in the second reaction zone are adjusted by mixing combustion air into the flue gases.

5. Process according to claim 4, characterized in that the temperature range in the second reduction zone is adjusted by way of the volume and temperature of the added combustion air.

* * * * *